US007268762B2

(12) United States Patent
Kitagawa et al.

(10) Patent No.: US 7,268,762 B2
(45) Date of Patent: Sep. 11, 2007

(54) DISPLAY DEVICE, DRIVING CIRCUIT FOR THE SAME AND DRIVING METHOD FOR THE SAME

(75) Inventors: Daiji Kitagawa, Tenri (JP); Toshiya Aoki, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 465 days.

(21) Appl. No.: 10/656,333

(22) Filed: Sep. 8, 2003

(65) Prior Publication Data

US 2004/0056833 A1 Mar. 25, 2004

(30) Foreign Application Priority Data

Sep. 25, 2002 (JP) ..... 2002-279937

(51) Int. Cl.
*G06G 3/36* (2006.01)

(52) U.S. Cl. ..... 345/98; 345/204

(58) Field of Classification Search ..... 345/76–79, 345/204–206, 87–100; 315/169.3
See application file for complete search history.

(56) References Cited

U.S. PATENT DOCUMENTS 6,653,900 B2 * 11/2003 Bu ..... 330/253
6,677,923 B2 * 1/2004 Kajihara et al. ..... 345/89
6,753,880 B2 * 6/2004 Kudo et al. ..... 345/690

FOREIGN PATENT DOCUMENTS

JP 2002-149125 5/2002

* cited by examiner

*Primary Examiner*—Regina Liang
(74) *Attorney, Agent, or Firm*—Harness, Dickey & Pierce, P.L.C.

(57) ABSTRACT

In a buffer that outputs an analog voltage Vout to be applied as a driving voltage to a pixel capacitance in a display region of an active-matrix liquid crystal display device, a CMOS circuit for generating this analog voltage includes four Pch transistors (QP0 to QP3) connected in parallel and four Nch transistors (QN0 to QN3) connected in parallel. When charging the pixel capacitance, a bias current is reduced and the driving capability is lowered by control with selector switches ($SP_1$ to $SP_3$) at a time at which the large driving capability at the beginning of the charging is not necessary anymore. And when discharging the charge that has accumulated at the pixel capacitance, the bias current is reduced and the driving capability is lowered by control with selector switches ($SN_1$ to $SN_3$) at a time at which the large driving capability at the beginning of the discharging is not necessary anymore. With this configuration, it is possible to reduce the power consumption of the output buffer applying the analog voltage for image display to the capacitive load in the display panel.

14 Claims, 15 Drawing Sheets

101
Liquid crystal controller
SSP
SCLK
AV
GSP
GCLK
100 Main unit
102 Source driver
20
Shift register
21
AS1
AS2
AS3
ASn-1
ASn
103
Gate driver
G1
G2
G3
Gm-1
Gm
S1
S2
S3
Sn-1
Sn
104 Display region

DISPLAY DEVICE, DRIVING CIRCUIT FOR THE SAME AND DRIVING METHOD FOR THE SAME

BACKGROUND OF THE INVENTION

1. Field of the Invention

The present invention relates to display devices driven with a voltage-controlled matrix of capacitive loads, such as an active-matrix liquid crystal display device, and more specifically to driving circuits and driving methods for such display devices.

2. Description of the Related Art

In portable information devices, such as mobile phones, PDAs (personal digital assistants) or notebook computers, there is a high demand for reducing power consumption in view of prolonging the battery life of the built-in battery. On the other hand, due to enhanced processing capabilities and more sophisticated use of these portable information devices, a demand has developed for high-quality display capabilities with more display colors. For this reason, the display devices used in such portable information devices should be adapted to the need for high-quality display capabilities, and TFT (thin film transistor) active-matrix liquid crystal display devices (in the following referred to as "TFT-LCD devices") have come to be used in place of conventional passive-matrix liquid crystal display devices.

In TFT-LCD devices, a voltage corresponding to an image signal is applied as a data signal to a display region (display portion) including capacitive loads, thereby displaying an image in that display region. Since the voltage to be applied to the display region is an analog voltage, a buffer outputting an analog signal as the data signal to be applied to the display portion (below, simply referred to as "output buffer"), such as a buffer of a D/A converter generating the analog voltage from a digital video signal, needs to perform an analog operation. Therefore, a bias current corresponding to the necessary driving capability has to be supplied to that internal portion, in order to operate the output buffer. As a result, in TFT-LCD devices, the proportion of the power consumption of that driving circuit that is taken up by the power consumption of the output buffer is large. In TFT-LCD devices that are built into the above-mentioned portable information devices, a small display region (display portion) with few pixels is used, and also the horizontal scanning frequency is low, so that the proportion of the power consumption taken up by the output buffer is particularly large. Furthermore, if dot-sequential driving is performed, as in TFT-LCD devices in which the TFTs are formed with continuous grain silicon (in the following referred to as "CG silicon"), then, because of the charging and discharging of the capacitive loads in the display region, an output buffer becomes necessary that has a driving capability that is much larger than in the case of line-sequential driving. For this reason, also in dot-sequential driving-type TFT-LCD devices, the proportion of the consumption power taken up by the output buffer is particularly large.

To address this issue, JP 2002-149125A discloses a liquid crystal display device in which the number of analog buffers (output buffers) is reduced by providing for each set of a plurality of data lines one analog buffer that receives an analog signal obtained by D/A conversion of a digital signal representing the image to be displayed, and outputs a data signal (analog voltage) to be applied to the data lines of the display panel. With this liquid crystal display device, energy is saved by reducing the number of analog buffers (output buffers).

However, this energy-saving conventional technology does not reduce the power consumption of the output buffers themselves. Furthermore, this conventional technology is premised on line-sequential driving and cannot be applied to dot-sequential driving in which one output buffer is provided from the outset for a plurality of data lines.

SUMMARY OF THE INVENTION

It is thus an object of the present invention to provide a display device that can display images by applying an analog voltage to capacitive loads, such as a TFT-LCD device, in which the power consumption of the buffer outputting the analog signal is reduced.

According to one aspect of the present invention, a display device which includes a display portion having a capacitive load and an output buffer having a driving capability that depends on a bias current, and which displays an image on the display portion by letting the output buffer apply an analog voltage corresponding to an input image signal to the capacitive load to drive the display portion, comprises:

a bias current control portion that controls the bias current;

wherein the output buffer is configured such that the bias current can be dynamically changed; and wherein the bias current control portion changes the bias current while the display portion is driven.

With this configuration, by changing the bias current of the output buffer while the display portion is driven, the bias current is changed in accordance with driving capability that is necessary for the output buffer, so that the power consumption of the output buffer can be reduced compared to conventional configurations, in which the bias current stayed fixed.

In such a display device, it is preferable that the output buffer includes:

a plurality of transistors, connected in parallel, for outputting the analog voltage; and a switching circuit for switching at least one of the plurality of transistors between an operative state and an inoperative state;

wherein the bias current control portion changes the bias current by changing the number of said plurality of transistors that are in the operative state with the switching circuit.

With this configuration, the output conductance can be changed by changing the number of the plurality of transistors connected in parallel that are in the operative state, so that the bias current can be changed in accordance with the driving capability necessitated by the output buffer, which makes it possible to reduce the power consumption of the output buffer.

In the above display device, the output buffer may include:

a transistor that outputs the analog voltage; and an operating point changing circuit that changes an operating point of the transistor;

wherein the bias current control portion changes the bias current by changing the operation point of the transistor with the operating point changing circuit.

With this configuration, the bias current can be changed in accordance with the driving capability necessitated by the output buffer by changing the operation point of the transistor, which makes it possible to reduce the power consumption of the output buffer.

In the above display device, it is further preferable that the bias current control portion changes the bias current during a charge period or a discharge period, which is a period during which the output buffer is to apply the analog voltage to the capacitive load.

With this configuration, the bias current can be changed in accordance with the driving capability necessitated by the output buffer by changing the bias current of the output buffer during the charge period or the discharge period of the capacitive load of the display portion, so that the power consumption of the output buffer can be reduced compared to conventional configurations, in which the bias current stayed fixed.

In this display device, it is preferable that the bias current control circuit controls the bias current such that, after a predetermined time within the charge period or the discharge period, the bias current is smaller than at the beginning of that charge period or discharge period.

With this configuration, after a predetermined time within the charge period or the discharge period, the bias current of the output buffer takes on a value that is lower than at the beginning of that charge period or discharge period, so that the bias current can be reduced after a time at which the charge/discharge current for the capacitive load of the driving portion has been reduced and the necessary driving capability is lowered. Therefore, it becomes possible to reduce the power consumption of the output buffer while suppressing any influence on the display with the display portion.

In this display device, the bias current control circuit may determine, based on the input image signal, a time within the charge period or the discharge period at which the bias current is to be reduced, and controls the bias current such that, after that determined time, the bias current is smaller than at the beginning of the charge period or the discharge period.

With this configuration, the bias current of the output buffer takes on a value that is smaller than at the beginning of the charge period or the discharge period after a time within the charge period or the discharge period that is determined based on the input image signal, so that the bias current can be reduced after a time at which the charge/discharge current for the capacitive load of the driving portion has been reduced and the necessary driving capability is lowered. Therefore, it becomes possible to reduce the power consumption of the output buffer while suppressing any influence on the display with the display portion.

In this display device, the bias current control circuit may determine, based on a charge/discharge current flowing between the output buffer and the capacitive load, a time within the charge period or the discharge period at which the bias current is to be reduced, and control the bias current such that, after that determined time, the bias current is smaller than at the beginning of that charge period or discharge period.

With this configuration, the bias current takes on a value that is smaller than at the beginning of the charge period or the discharge period after a time within the charge period or the discharge period that is determined based on the charge/discharge current flowing between the output buffer and the capacitive load, so that the bias current can be reduced after a time at which the charge/discharge current for the capacitive load of the driving portion has been reduced and the necessary driving capability is lowered. Therefore, it becomes possible to reduce the power consumption of the output buffer while suppressing any influence on the display with the display portion.

In this display device, the bias current control portion may completely stop the bias current after the time that has been determined as the time within the charge period or the discharge period at which the bias current is to be reduced.

With this configuration, no bias current at all flows after a time that has been determined as the time within the charge period or the discharge period at which the bias current is to be reduced, so that the power consumption of the output buffer can be reduced even further.

According to another aspect of the present invention, a driving circuit that, in order to display an image on a display portion including a capacitive load, drives the display portion by applying an analog voltage corresponding to an input image signal to the capacitive load with an output buffer that has a driving ability that depends on a bias current, includes:

a bias current control portion that controls the bias current;

wherein the output buffer is configured such that the bias current can be dynamically changed; and wherein the bias current control portion changes the bias current while the display portion is driven.

In this driving circuit, it is preferable that the bias current control portion changes the bias current during a charge period or a discharge period, which is a period during which the output buffer is to apply the analog voltage to the capacitive load.

According to yet another aspect of the present invention, a driving method for driving a display portion including a capacitive load, in order to display an image on the display portion, by applying an analog voltage corresponding to an input image signal to the capacitive load with an output buffer that has a driving ability that depends on a bias current, includes:

a bias current changing step of changing the bias current while the display portion is driven.

In this driving method, it is preferable that the bias current is changed during a charge period or a discharge period, which is a period during which the output buffer is to apply the analog voltage to the capacitive load.

These and other objects, features, aspects and advantages of the present invention will become more apparent from the following detailed description of the present invention when taken in conjunction with the accompanying drawings.

DESCRIPTION OF THE PREFERRED EMBODIMENTS

The following is a description of embodiments of the present invention, with reference to the accompanying drawings.

1. First Embodiment

1.1 Overall Configuration and Operation

Figure 1:
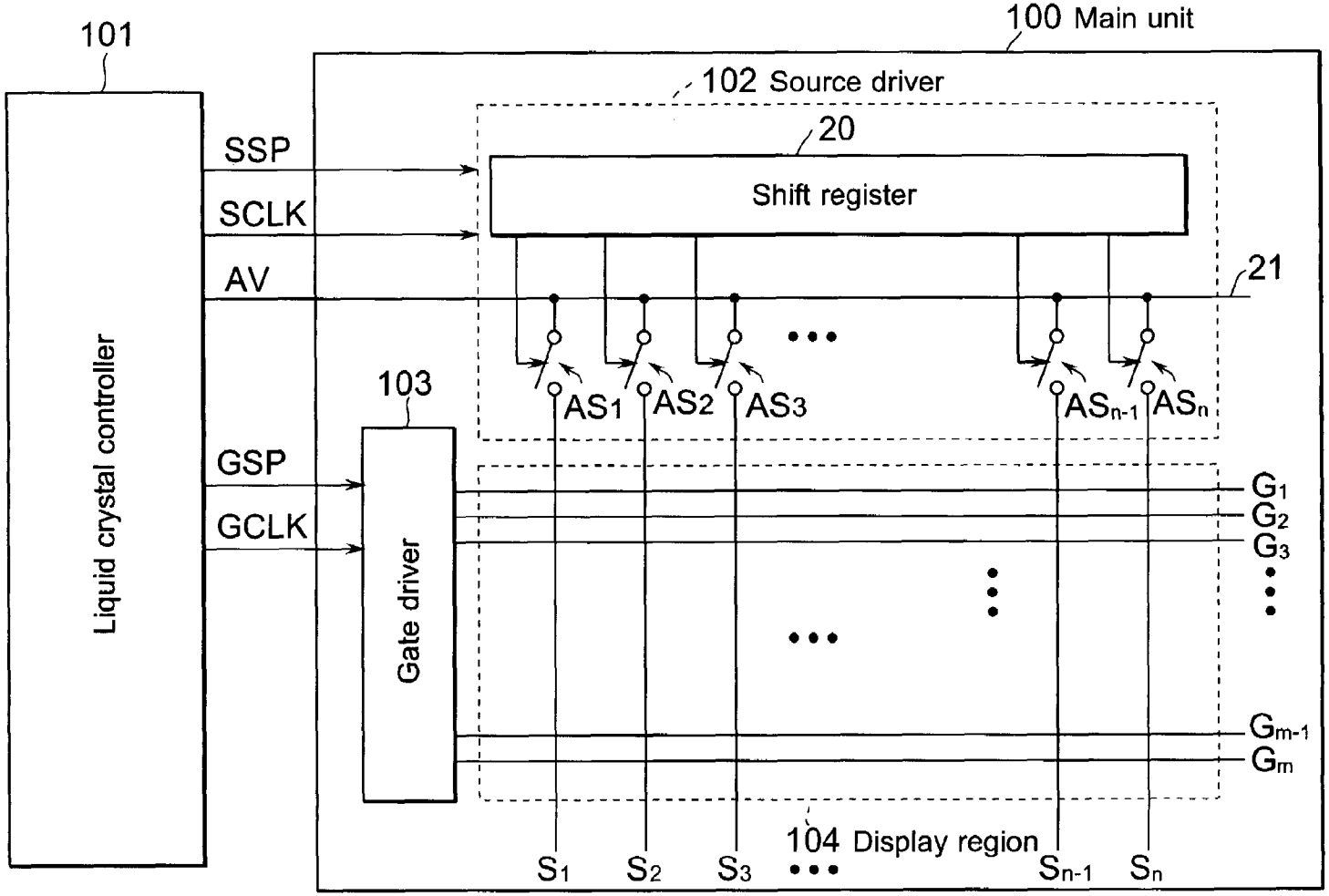
FIG. 1 is a block diagram showing the configuration of a liquid crystal display device according to a first embodiment of the present invention.

FIG. 1 is a block diagram showing the configuration of a liquid crystal display device according to a first embodiment of the present invention. This liquid crystal display device is made of a liquid crystal controller 101 serving as a display control circuit, a source driver 102 serving as a data line driving circuit, a gate driver 103 serving as a scanning line driving circuit, and an active-matrix display region 104 serving as a display portion. The display region 104, the source driver 102 and the gate driver 103 together make up a main unit.

Figure 2:
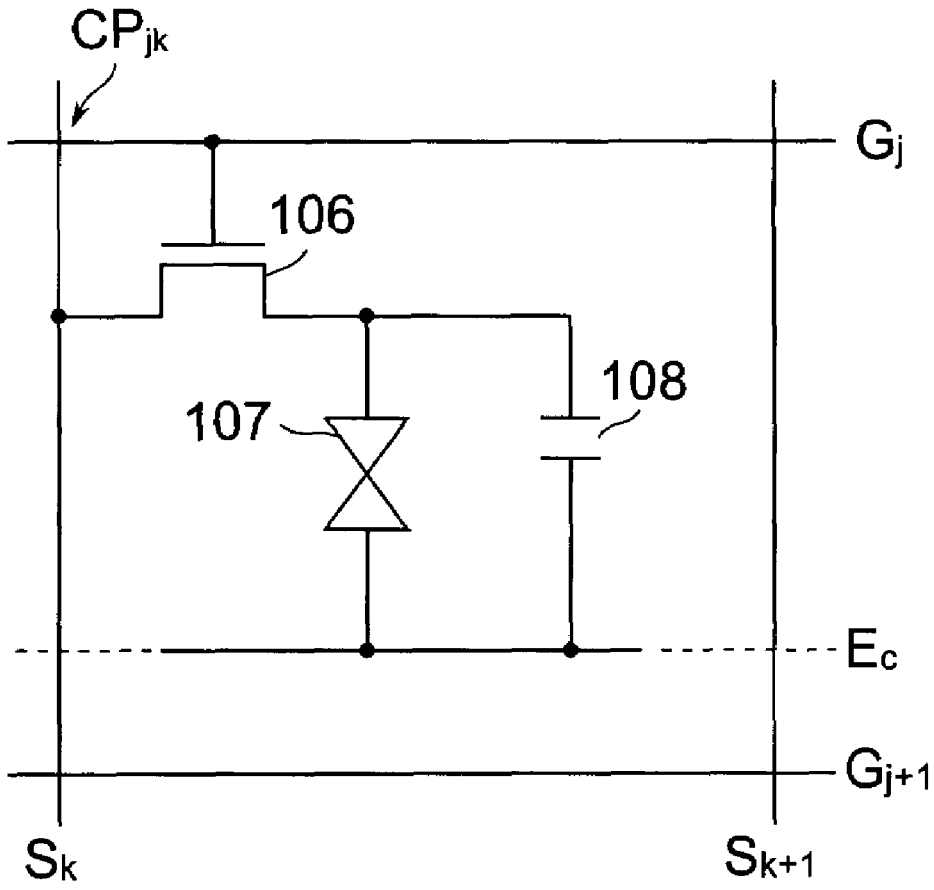
FIG. 2 is a circuit diagram illustrating the configuration of a pixel formation portion that is part of the display region in the first embodiment.

The display region 104 includes m gate bus lines $G_1$ to $G_m$, n source bus lines $S_1$ to $S_n$, and m×n pixel formation portions. The m gate bus lines $G_1$ to $G_m$ serve as scanning signal lines corresponding to horizontal scanning lines in the image representing image data DV1 obtained from an external signal source. The n source bus lines $S_1$ to $S_n$ serve as data lines intersecting with the gate bus lines $G_1$ to $G_m$. The m×n pixel formation portions are respectively provided at the points where the gate bus lines $G_1$, to $G_m$ intersect with the source bus lines. These pixel formation portions are arranged in a matrix, and as shown in FIG. 2, each pixel formation portion is made of a TFT 106, a pixel electrode 107, a common electrode Ec, a liquid crystal layer, and a charge-holding capacitance 108. The TFT 106 functions as a switch element, and its source terminal is connected to a source bus line $S_k$ passing through a corresponding intersection $CP_{jk}$. The pixel electrode 107 is connected to the drain terminal of that TFT 106. The common electrode Ec is an opposing electrode that is shared by the above-noted plurality of pixel formation regions. The liquid crystal layer is shared by the above-noted plurality of pixel formation regions and is sandwiched between the pixel electrode 107 and the common electrode Ec. The charge-holding capacitance 108 is formed in parallel to the capacitance formed by the pixel electrode 107 and the common electrode Ec. The pixel capacitance is constituted by the charge-holding capacitance 108 and the capacitance formed by the pixel electrode 107 and the common electrode Ec.

The liquid crystal controller 101 obtains a digital video signal from a signal source, such as a personal computer (PC), and generates, as the signals for displaying on the display region 104 an image represented by the digital video signal, a source driver start pulse SSP, a source driver clock signal SCLK, an analog video signal AV which is the analog voltage signal to be applied to the source drivers $S_1$ to $S_n$, a gate driver start pulse GSP, and a gate driver clock signal GCLK.

The source driver 102 includes a shift register 20, a video line 21 for transmitting the analog video signal AV, and n analog switches $AS_1$ to $AS_n$ that are respectively inserted between the video line 21 and the source bus lines $S_1$ to $S_n$. The source driver 102 receives the source driver start pulse SSP, the source driver clock signal SCLK, and the analog video signal AV from the liquid crystal controller 101. The shift register 20 is made of n flip-flops corresponding to the source bus lines $S_1$ to $S_n$, and the output of each flip-flop controls the on/off position of the analog switch connected to the corresponding source bus line. Moreover, the start pulse SSP and the source driver clock signal SCLK are input into the shift register 20, and the start pulse SSP is sequentially shifted in accordance with the source driver clock signal SCLK. Thus, the analog switches $AS_1$ to $AS_n$ are sequentially turned on each for a predetermined period of time, so that dot sequential driving is performed. That is to say, the analog video signal AV is sequentially applied to the source bus lines $S_1$ to $S_n$ each for a predetermined period of time.

The gate driver 103, which is also internally provided with a shift register, receives a gate driver start pulse GSP and a gate driver clock signal GCLK from the liquid crystal controller 101. The internal shift register is made of m flip-flops corresponding to the gate bus lines $G_1$ to $G_m$, and the output of each flip-flop is connected to the corresponding gate bus line. The gate driver start pulse GSP is entered into this internal shift register once at every vertical scanning period, and this start pulse GSP is shifted sequentially in accordance with the gate driver clock signal GCLK. Thus, the gate bus lines $G_1$ to $G_m$ in the display region 104 are sequentially selected each for one horizontal scanning period, and the active scanning signal (voltage turning on the TFT) is applied only to the selected gate bus line.

In the display region 104 as described above, the analog video signal AV is applied by the source driver 102 to the source bus lines $S_1$ to $S_n$ as a video driving signal, and the scanning signal is applied by the gate driver 103 to the gate bus lines $G_1$ to $G_m$. Thus, depending on the analog video signal AV, a voltage corresponding to the potential difference between the pixel electrode and the common electrode Ec is applied to the liquid crystal layer. The display region 104 displays an image indicated by the digital video signal received from the external signal source, such as a PC, by controlling the optical transmittance of the liquid crystal layer through this applied voltage.

It should be noted that with polycrystalline silicon or CG silicon or the like, the source driver 102 and the gate driver 103 may be formed on the same substrate as the display region 104. Liquid crystal display devices in which the display portion and the driving circuit portion are integrated like this on the same substrate are called "driver monolithic LCD devices." In this case, the main unit 100 of the liquid crystal display device is a display panel including the driving circuit.

1.2 Liquid Crystal Controller

Figure 3:
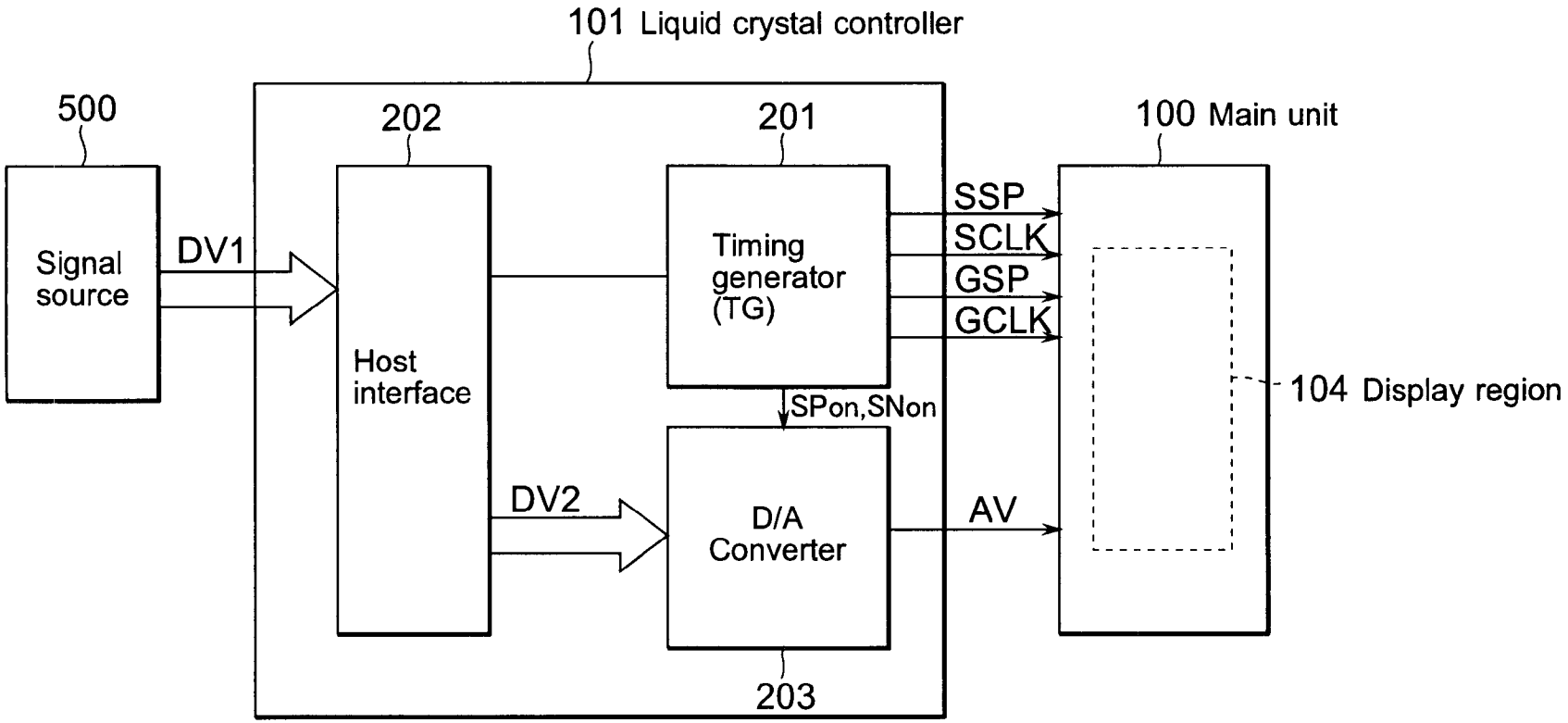
FIG. 3 is a block diagram showing the configuration of the liquid crystal controller in the first embodiment.

FIG. 3 is a block diagram showing the configuration of the liquid crystal controller 101 in the above-described liquid crystal display device, as well as the external signal source 500 and the main unit 100 including the display region 104. The liquid crystal controller 101 is provided with a timing generator 201, a host interface 202, and a D/A converter 203. The timing generator 201 generates the above-mentioned signals SSP, SCLK, GSP and GCLK, which are the driving signals given to the driving region 104, at a timing that is suitable for the display region 104, and furthermore generates a timing signal for operating the host interface 202 and the D/A converter 203 at suitable timing. The host interface 202 receives a digital video signal DV1 from the external signal source 500, and applies a digital video signal DV2 based on the digital video signal DV1 to the D/A converter 203, at a suitable timing in cooperation with the timing generator 201. The D/A converter 203 converts the digital video signal DV2 into an analog signal, which is outputted as the analog video signal AV. This analog video signal AV is applied, as described above, via the source driver 102 of the main unit 100 to the capacitive loads made of the pixel capacitances in the display region 104, and the wiring capacitances and wiring resistances of the source bus lines S1 to $S_n$.

1.3 The D/A Converter

Figure 4:
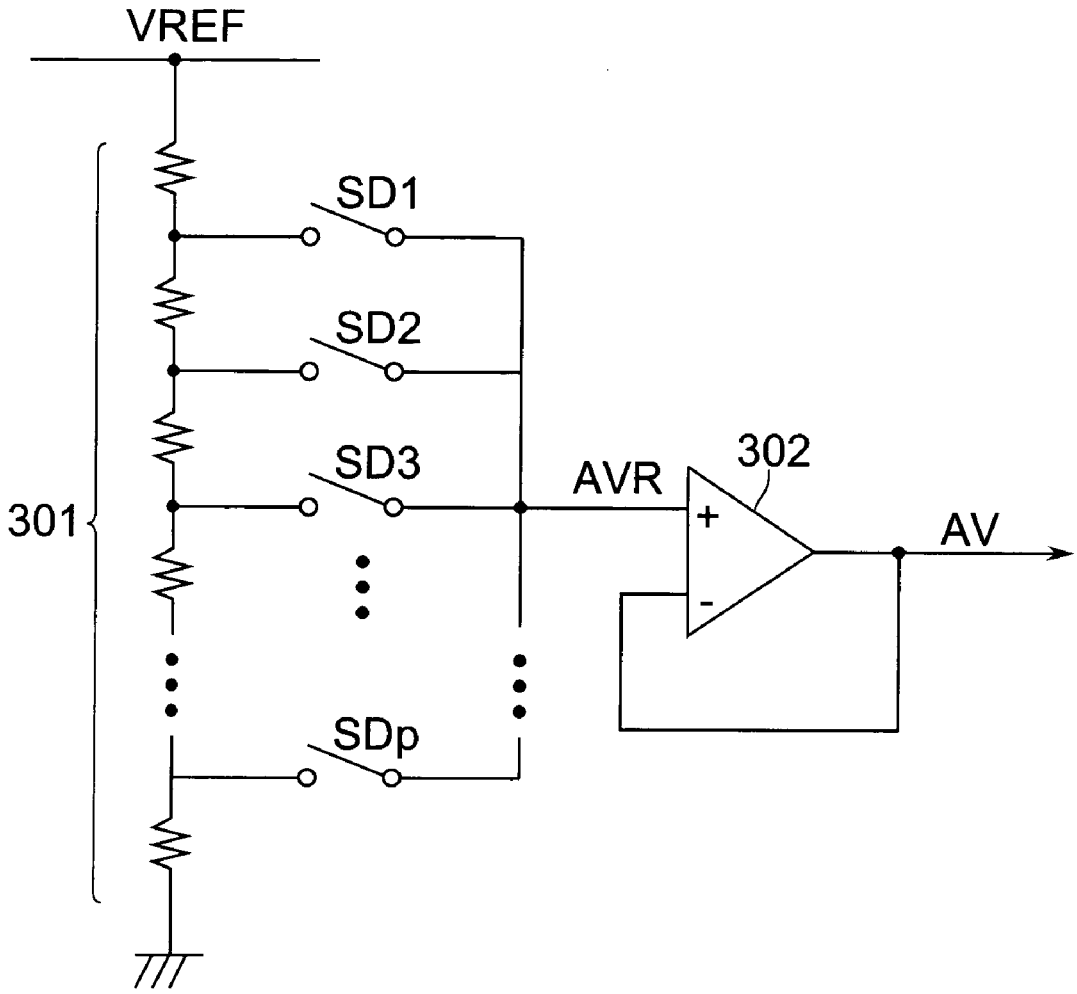
FIG. 4 is a circuit diagram showing the configuration of a conventional example of a D/A converter used for the liquid crystal controller.

FIG. 4 is a circuit diagram showing the configuration of a conventional example of a D/A converter used for a liquid crystal controller as described above. In this conventional example, the D/A converter is made of a voltage divider circuit 301, a group of switches $SD_1$ to $SD_p$, and an output buffer 302. The voltage divider circuit 301 is made of p+1 resistors connected in series, dividing a predetermined reference voltage VREF. The group of switches $SD_1$ to $SD_p$ is made of p analog switches for selecting one of the p voltages obtained with the voltage divider circuit 301 in accordance with the digital video signal DV2, which is the input signal. The output buffer 302 receives the voltage that has been selected in accordance with the digital video signal DV2 as an input analog video signal AVR, and outputs a signal of the same potential as the analog video signal AV. The output buffer 302 is for obtaining the driving capability that is needed to drive the display region 104, and functions as a voltage follower as shown in FIG. 4.

Figure 5:
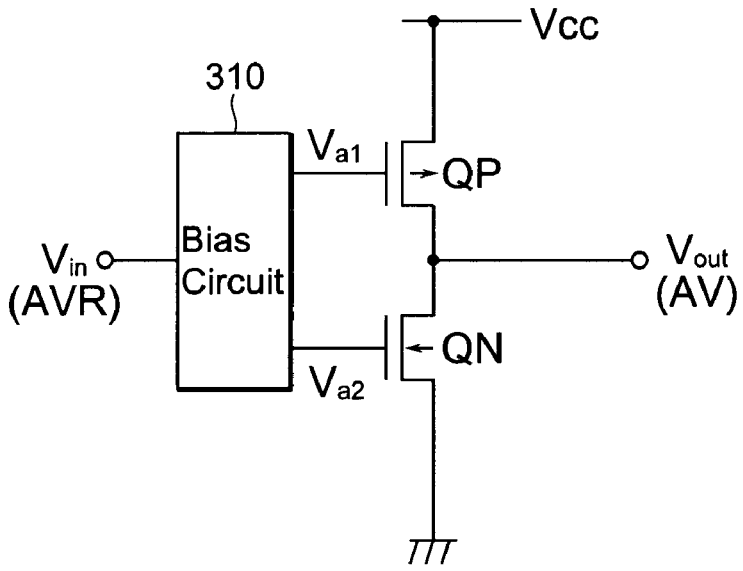
FIG. 5 is a circuit diagram showing the configuration of the output buffer in the conventional example of a D/A converter.

FIG. 5 is a circuit diagram showing a configuration example of the output buffer 302 in a conventional example of the D/A converter. In this example, the output buffer 302 includes a CMOS (complementary metal oxide semiconductor) circuit and a bias circuit 310. The CMOS circuit is made of a P-channel MOS (metal oxide semiconductor) transistor (referred to in short as "Pch transistor" in the following) QP whose source terminal is connected to a power source line VCC, and an N-channel MOS transistor (referred to in short as "Nch transistor" in the following) QN whose source terminal is connected to ground. In accordance with the input voltage $V_{in}$, the bias circuit 310 respectively applies the bias voltages $Va_1$ and $Va_2$ to the gate terminal of the Pch transistor QP and the gate terminal of the Nch transistor QN. In this output buffer 302, the CMOS circuit carries out an analog operation (linear operation) based on the bias voltages $Va_1$ and $Va_2$, and outputs a voltage $V_{out}$ (corresponding to the above-noted video signal AV) that is equivalent to the entered voltage $V_{in}$ (corresponding to the above-noted video signal AVR). Thus, the output buffer 302 necessitates a constant idling current for its analog operation. This means that even in a state in which no load is connected to the output terminal (open state), a current flows in the bias circuit 310, and a current flows from the power source line VCC through the CMOS circuit (Pch transistor QP and Nch transistor QN) to ground. Such currents are collectively called "bias current." The driving capability of the output buffer 302 depends on this bias current, and a large bias current is necessary to attain a large driving capability. However, the current flowing through the bias circuit 310 is small compared to the current flowing through the CMOS circuit, so that the following descriptions regarding the bias current focus only on the bias current flowing through the CMOS circuit.

Figure 6:
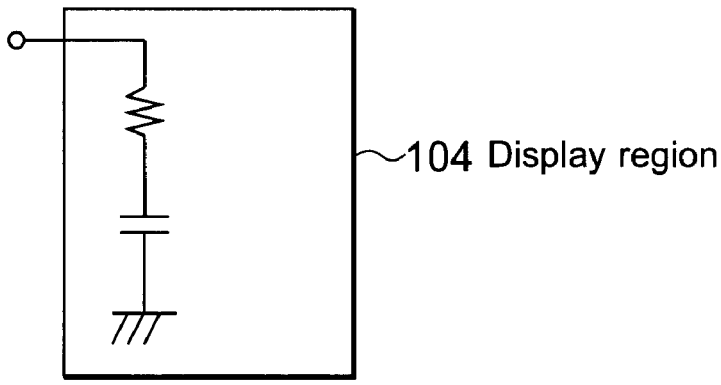
FIG. 6 is a circuit diagram illustrating a model of the display region as the load seen from the driving circuit in a liquid crystal display device.
Figure 7A:
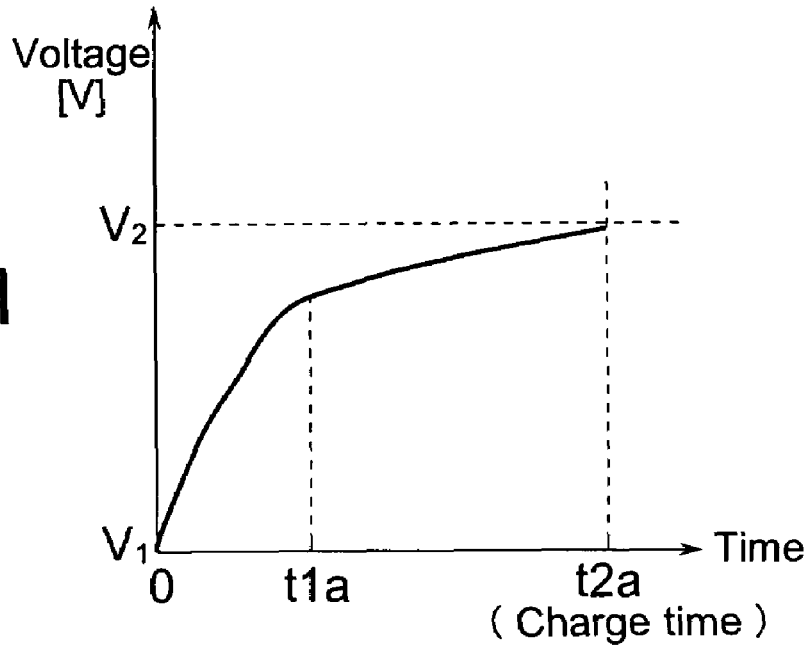
FIGS. 7A and 7B are graphs illustrating the change of the potential of the pixel electrode to be driven when the display region (which behaves like a CR load) is driven with a constant voltage.
Figure 7B:
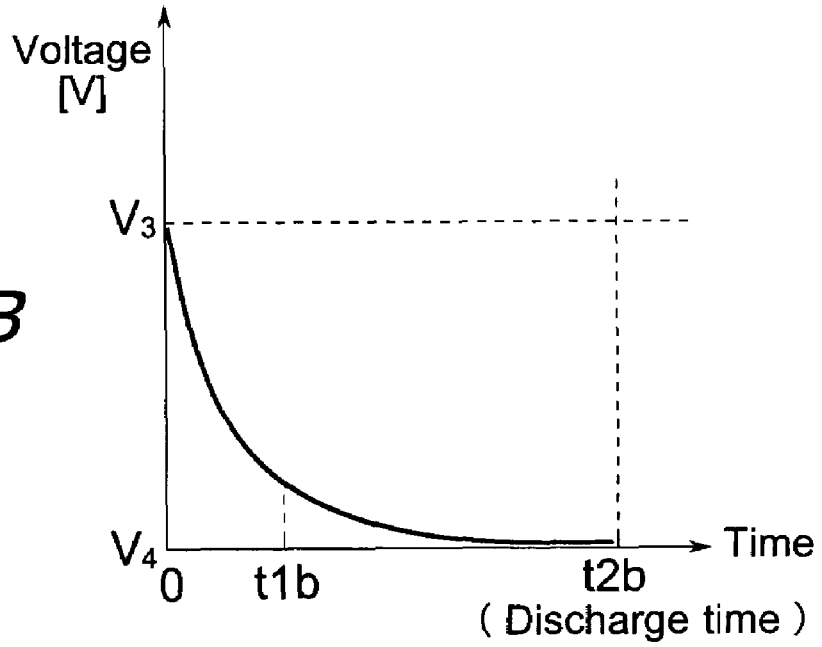

In the case of dot-sequential driving as in the liquid crystal display device of the present embodiment, a driving capability is necessary that is much higher than for line-sequential driving, in order to charge and discharge the display region 104 with the capacitive loads. Therefore, the bias current in the output buffer 302 of the D/A converter 203 must be made large in accordance with the driving capability, and thus also the power consumption of the entire liquid crystal display device becomes large. Now, seen from the output buffer 302 of the D/A converter 203, the display region 104 serving as the load can be treated in a simple model as a serial connection of a capacitor and a resistor, that is a CR load, as shown in FIG. 6. For this reason, if the display region 104 is driven at a constant voltage, the change of the potential of the pixel electrode to be driven can be described by a negative exponential function, as shown in FIG. 7. That is to say, when the display region 104 (which behaves like a CR load) is charged, then, taking the driving voltage of the output buffer 302 as $V_2$, and taking the value of the voltage at the capacitor in the CR load (corresponds to the potential of the pixel electrode to be driven, referred to as "target pixel potential" in the following) before the driving starts (before the driving voltage $V_2$ is applied) as $V_1$ (with $V_2>V_1$), the target pixel potential V after driving has started changes as shown in FIG. 7A. Furthermore, when the charged display region 104 (which behaves like a CR load) is discharged, then, taking the driving voltage of the output buffer 302 as $V_4$, and taking the target pixel potential, which is the voltage at the capacitor in the CR load, before the driving starts in the CR load as $V_3$ (with $V_4<V_3$), the target pixel potential V after driving has started changes as shown in FIG. 7B. Consequently, in both cases of charging and discharging, the current flowing between the output buffer 302 and the CR load decreases with time. Thus, it seems that even when the driving capability of the output buffer 302 is reduced in the latter half of one driving period (charge period or discharge period) of a target pixel, the driving capability is not substantially decreased.

The present embodiment exploits this aspect, and reduces the current consumption of the output buffer itself without substantially lowering the driving capability, by making the bias current of the output buffer from a predetermined time in each driving period after the driving has begun smaller than at the driving start.

Figure 8:
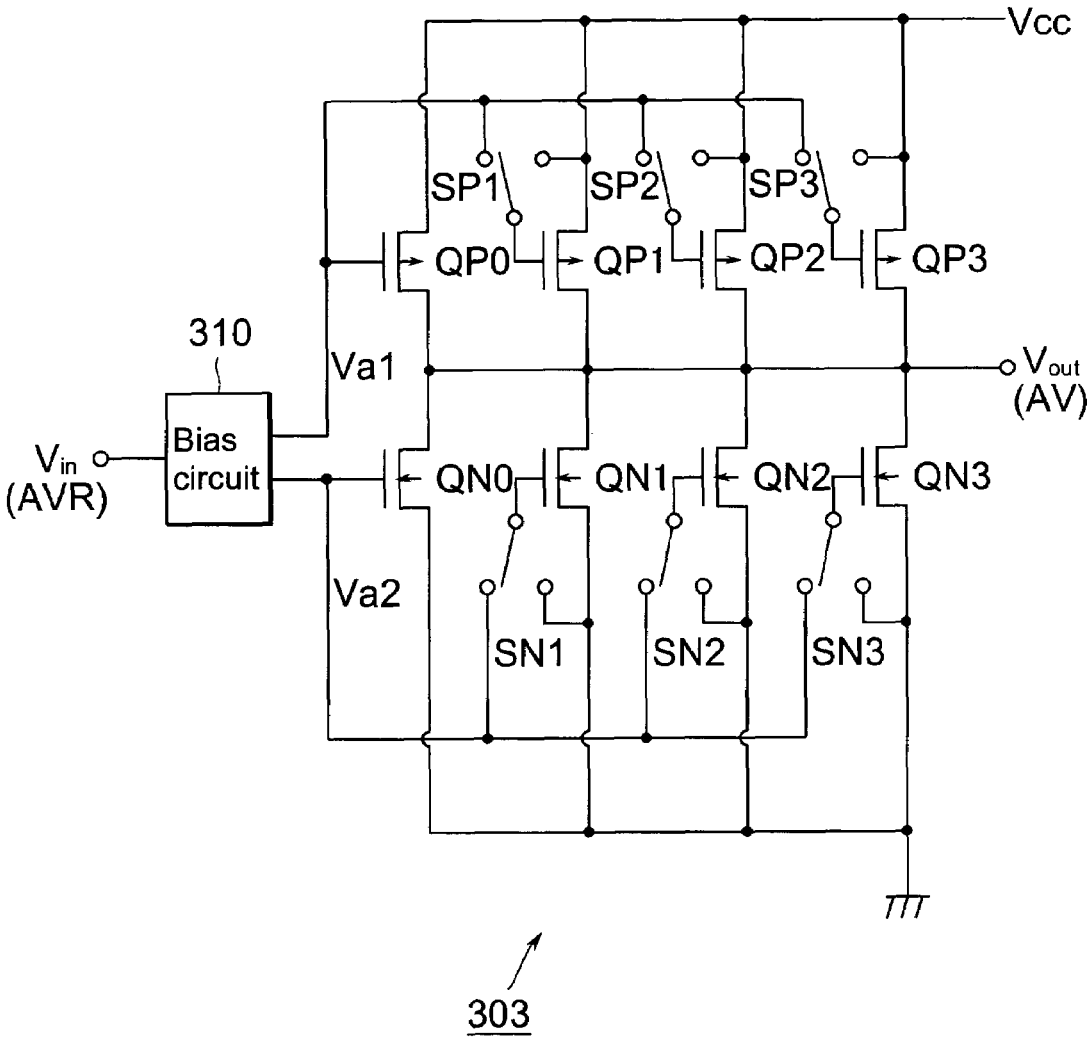
FIG. 8 is a circuit diagram showing the configuration of an output buffer of the D/A converter in accordance with the first embodiment.

FIG. 8 is a circuit diagram showing the configuration of an output buffer 303 of the D/A converter 203 in accordance with the present embodiment. In this configuration, the bias circuit 310 is similar to the one in the conventional example (FIG. 5), but the CMOS circuit for generating the driving voltage $V_{out}$ (corresponds to the analog video signal AV) in the output buffer 303 is made of four Pch transistors $QP_0$ to $QP_3$ connected in parallel and four Nch transistors $QN_0$ to $QN_3$ connected in parallel. Here, the size (characteristics) of the Pch transistors $QP_0$ to $QP_3$ and the Nch transistors $QN_0$ to $QN_3$ is set such that a driving capability equivalent to that of the conventional example is attained (that is, a bias current flows that is as large as the bias current in the conventional example) when all four Pch transistors $QP_0$ to $QP_3$ and all four Nch transistors $QN_0$ to $QN_3$ are activated (in the operative state). The bias voltage $Va_1$ that is output from the bias circuit 310 as the voltage to be supplied to the gate terminal of the Pch transistors of the CMOS circuit is applied directly to the gate terminal of the Pch transistor $QP_0$, but is applied to the other Pch transistors $QP_1$ to $QP_3$ via selector switches $SP_1$ to $SP_3$. These selector switches $SP_1$ to $SP_3$ are switched with a Pch control signal SPon mentioned later, and accordingly the bias voltage $Va_1$ is applied to the gate terminals of the Pch transistors $QP_1$ to $QP_3$ when the Pch control signal SPon is high (at H level), whereas the voltage of the power source line VCC (H level) is applied when the Pch control signal SPon is low (at L level). Consequently, when the Pch control signal SPon is at H level, all Pch transistors $QP_0$ to $QP_3$ operate in accordance with the bias voltage $Va_1$ (linear operation), whereas when the Pch control signal SPon is at L level, only the Pch transistor $QP_0$ operates in accordance with the bias voltage $Va_1$, and the other Pch transistors $QP_1$ to $QP_3$ are turned off (in the inoperative state).

Furthermore, the bias voltage $Va_2$ that is output from the bias circuit 310 as a voltage to be supplied to the gate terminals of the Nch transistors of the CMOS circuit is applied directly to the gate terminal of the Nch transistor $QN_0$, but is applied to the other Nch transistors $QN_1$ to $QN_3$ via selector switches $SN_1$ to $SN_3$. These selector switches $SN_1$ to $SN_3$ are switched with a Nch control signal SNon mentioned later, and accordingly the bias voltage $Va_2$ is applied to the gate terminals of the Nch transistors $QN_1$ to $QN_3$ when the Nch control signal SNon is at high level (H level), whereas ground level (L level) is applied when the Nch control signal SNon is at L level. Consequently, when the Nch control signal SNon is at H level, all Nch transistors $QN_0$ to $QN_3$ operate in accordance with the bias voltage $Va_2$ (linear operation), whereas when the Nch control signal SNon is at L level, only the Nch transistor $QN_0$ operates in accordance with the bias voltage $Va_2$, and the other Nch transistors $QN_1$ to $QN_3$ are turned off (in the inoperative state).

Figure 9:
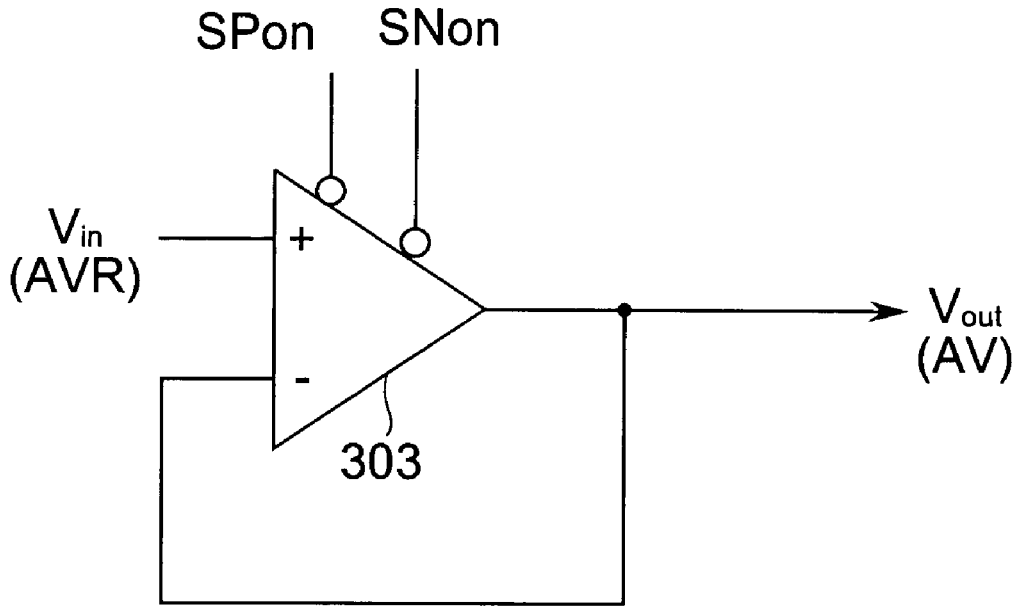
FIG. 9 is a diagram in which the output buffer of the D/A converter in the first embodiment is represented by a voltage follower.
Figure 10A:
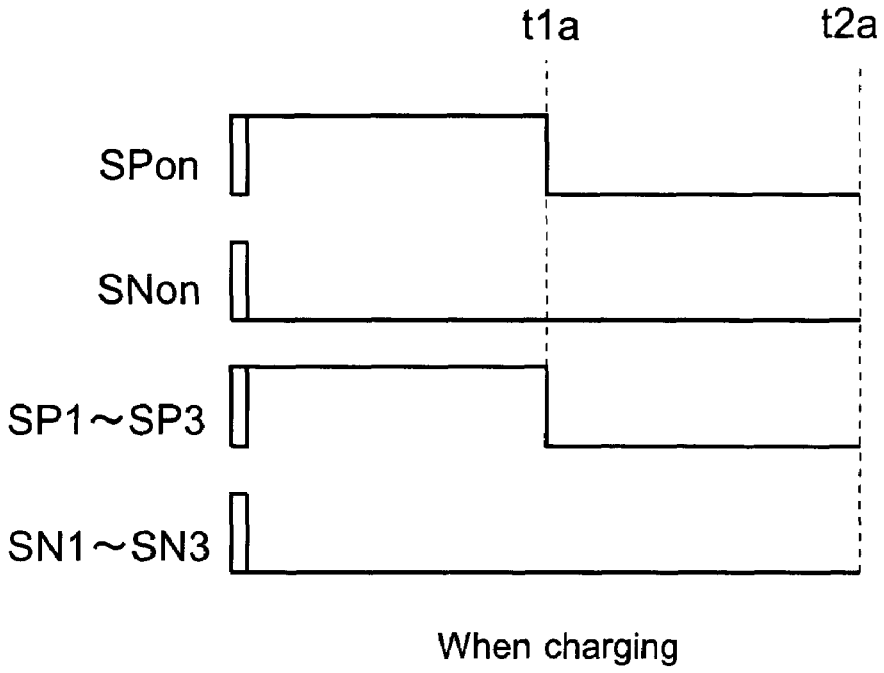
FIGS. 10A and 10B are timing charts illustrating the operation of the output buffer according to the first embodiment.
Figure 10B:
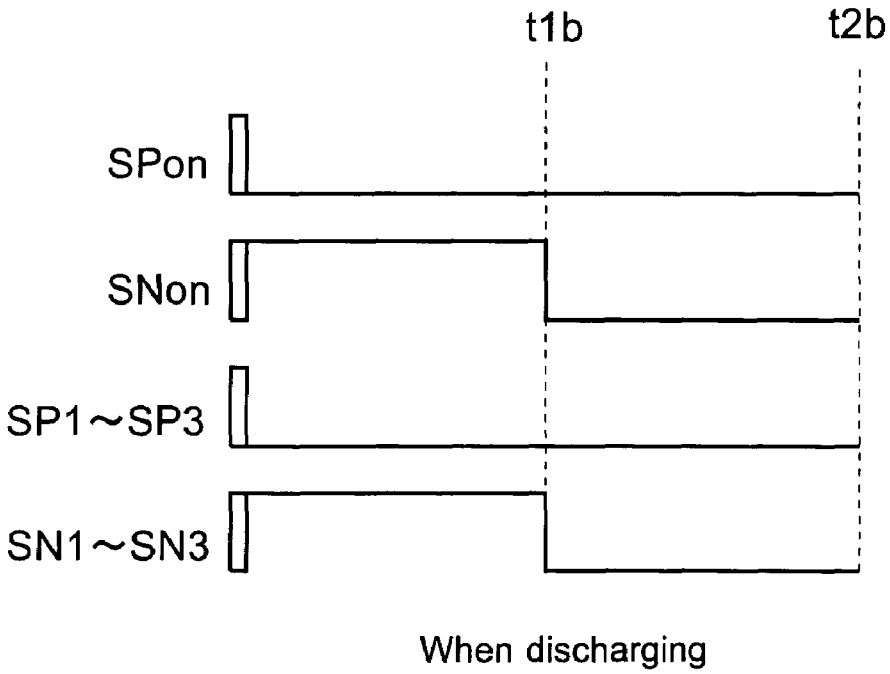

The output buffer 303 configured as described above, can be represented using a voltage follower, as shown in FIG. 9. In this output buffer 303, the Pch control signal SPon controlling the Pch transistors $QP_1$ to $QP_3$ of the output buffer 303 in the manner described above, as well as the Nch control signal SNon controlling the Nch transistors $QN_1$ to $QN_3$ in the manner described above are input in addition to the analog video signal AVR serving as the input voltage $V_{in}$. The Pch control signal SPon and the Nch control signal SNon are generated by the timing generator 201 as signals indicating the point in time that has been set in advance as the point in time that is suitable for reducing the driving capability during each driving period (charge or discharge period for writing the pixel value for one pixel). That is to say, if the voltage to be applied to the display region 104 (target pixel capacitance), is higher than the voltage that is currently applied to the target pixel capacitance, then the driving period with the voltage to be applied can be regarded as a charge period, and in this charge period, the timing generator 201 sets the Pch control signal SPon to H level at the beginning of the charging, changes it to L level at a predetermined time t1a after the beginning of the charging, and then maintains it at the L level for the rest of the charge period, as shown in FIG. 10A. On the other hand, the Nch control signal SNon is maintained at L level during the entire charge period. Here, the time from t=0 to t=t2*a* is the charge period, and the time t=t1*a* is a point in time that has been set in advance, as noted above, as a suitable time for reducing the driving capability. Moreover, if the voltage to be applied to the display region 104 (target pixel capacitance), is lower than the voltage that is currently applied to the target pixel capacitance, then the driving period with the voltage to be applied can be regarded as a discharge period, and in this discharge period, the timing generator 201 sets the Nch control signal SNon to H level at the beginning of the charging, changes it to L level at a predetermined time t1*b* after the beginning of the charging, and then maintains it at the L level for the rest of the charge period, as shown in FIG. 10B. On the other hand, the Pch control signal SPon is maintained at L level during the entire discharge period. Here, the time from t=0 to t=t2*b* is the discharge period, and the time t=t1*b* is a point in time that has been set in advance, as noted above, as a suitable time for reducing the driving capability. It should be noted that in this embodiment, the Pch control signal SPon and the Nch control signal SNon are generated by the timing generator 201, and the bias current of the output buffer 303 is changed as mentioned below by the Pch control signal SPon and the Nch control signal SNon, so that the timing generator 201 functions as a bias current control portion.

In this embodiment, the level of either the Pch control signal SPon or the Nch control signal SNon is controlled as shown in FIGS. 10A and 10B, depending on whether it is a charge period or a discharge period, and whether it is a charge period or a discharge period, is judged depending on whether the voltage applied to the display region 104 (target pixel capacitance) is higher or lower than the voltage currently applied to the target pixel capacitance, as described above. For this judgment, a memory may be provided inside the liquid crystal controller 101 for example, and the voltages applied to the pixel capacitances in the prior frame period may be stored in that memory. Furthermore, most liquid crystal display devices are of the type in which the polarity of the voltage applied to the liquid crystal layer is inverted at each source bus line (source inversion type), or of the type in which the polarity is inverted not only at each source bus line but also at each gate bus line (dot inversion type), and in this case, the level of the Pch control signal SPon and the level of the Nch control signal SNon should be controlled in alternation.

1.4 Operation of the Output Buffer

When the display region 104 (which behaves like a CR load) is driven at a constant voltage, the target pixel potential V when charging changes as shown in FIG. 7A, as described above, and the charge current decreases over time, so that also the necessary driving ability diminishes over time. For this reason, when the same driving capability is provided during the entire charge period, a bias current flows in accordance with the driving capability, so that power is unnecessarily consumed in the output buffer.

With the present embodiment, on the other hand, the Pch control signal SPon is at H level, as shown in FIG. 10A, for a period of t=0 to t1*a* (see FIG. 7A), which is the period after the charging begins in which the potential V of a pixel to be charged increases sharply, and controlled by the selector switches $SP_1$ to $SP_3$, the four Pch transistors $QP_0$ to $QP_3$ in the output buffer 303 operate linearly based on the bias voltage $Va_1$. Thus, the output conductance becomes four times that of the case when only the Pch transistor $QP_0$ operates (assuming that the characteristics (size) of the Pch transistors $QP_0$ to $QP_3$ are the same), so that an accordingly large bias current flows, and the target pixel capacitance and the line capacitance of the display region 104 is charged with high driving capability. Yet in this embodiment, the driving capability (bias current) when all four Pch transistors $QP_0$ to $QP_3$ have been activated is the same as the driving capability (bias current) in the conventional example, as noted above. After that, at a time t=t1*a*, when the charging has proceeded to a certain degree, the Pch control signal SPon changes to the L level, and the three Pch transistors $QP_1$ to $QP_3$ in the output buffer 303 are turned off by the selector switches $SP_1$ to $SP_3$, so that only the Pch transistor $QP_0$ is operated linearly with the bias voltage $Va_1$ (see FIG. 8). As a result, the output conductance of the output buffer 303 becomes ¼ of that at the time when the charging started, the bias current becomes accordingly smaller, and the power consumption of the output buffer 303 is reduced considerably. The driving capability of the output buffer 303 is also lowered, but at this time, the charge current that needs to be supplied to the display region 104 has become small, so that a reduction of the driving capability poses no particular problem, and does not substantially affect the display with the display region 104. It should be noted that the Nch transistors $QN_0$ to $QN_3$ are not concerned with the charge current, so that the Nch control signal SNon is at L level throughout the entire charge period, as shown in FIG. 10A, and of the four Nch transistors $QN_0$ to $QN_3$, $QN_1$ to $QN_3$ are off, and only $QN_0$ operates. This aspect, too, contributes to the reduction in power consumption of the output buffer 303.

Furthermore, with the present embodiment, the Nch control signal SNon is at H level, as shown in FIG. 10B, for a period of t=0 to t1*b* (see FIG. 7B), which is the period after the discharging begins in which the potential V of a pixel to be discharged decreases sharply, and controlled by the selector switches $SN_1$ to $SN_3$, the four Nch transistors $QN_0$ to $QN_3$ in the output buffer 303 operate linearly based on the bias voltage $Va_2$ (see FIG. 8). Thus, the output conductance becomes four times that of the case when only the Nch transistor $QN_0$ operates (assuming that the characteristics (size) of the Nch transistors $QN_0$ to $QN_3$ are the same), so that an accordingly large bias current flows, and the charge that is accumulated by the target pixel capacitance and the line capacitance of the display region 104 is discharged with high driving capability. Yet in this embodiment, the driving capability (bias current) when all four Nch transistors $QN_0$ to $QN_3$ have been activated is the same as the driving capability (bias current) in the conventional example, as noted above. After that, at a time t=t1*b*, when the discharge has proceeded to a certain degree, the Nch control signal SNon changes to the L level, and the three Nch transistors $QN_1$ to $QN_3$ in the output buffer 303 are turned off by the selector switches $SN_1$, to $SN_3$, so that only the Nch transistor $QN_0$ is operated linearly with the bias voltage $Va_2$. As a result, the output conductance of the output buffer 303 becomes ¼ of that at the time when the discharging started, the bias current becomes accordingly smaller, and the power consumption of the output buffer 303 is reduced considerably. The driving capability of the output buffer 303 is also lowered, but at this time, the discharge current from the display region 104 has become small, so that a reduction of the driving capability poses no particular problem, and does not substantially affect the display with the display region 104. It should be noted that the Pch transistors $QP_0$ to $QP_3$ are not concerned with the discharge current, so that the Pch control signal SPon is at L level throughout the entire discharge period, as shown in FIG. 10B, and of the four Pch transistors $QP_0$ to $QP_3$, $QP_1$ to $QP_3$ are off, and only $QN_0$ operates. This aspect, too, contributes to the reduction in power consumption of the output buffer 303.

Figure 11A:
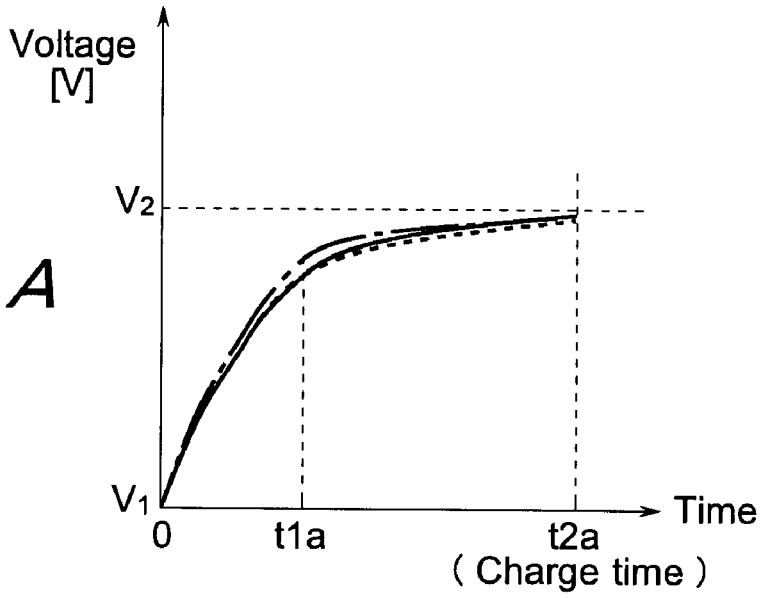
FIGS. 11A and 11B are waveform diagrams illustrating the operation of the output buffer according to the first embodiment.
Figure 11B:
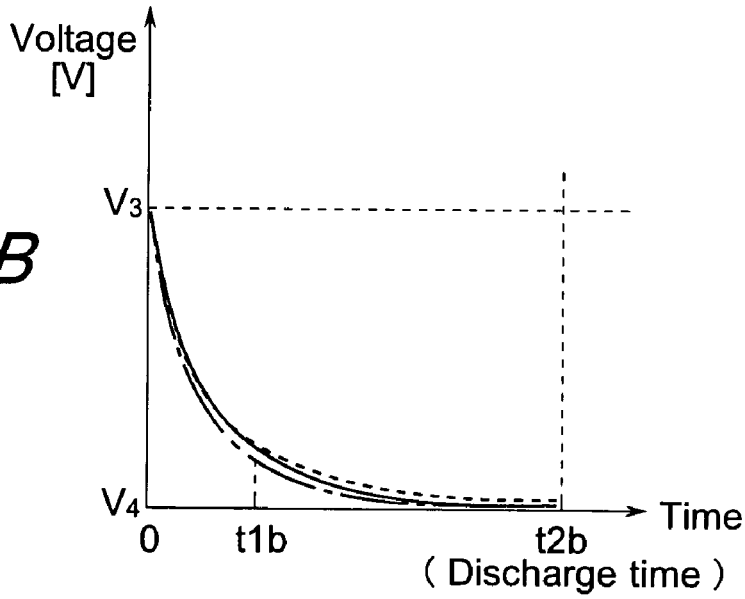

Thus, with the present embodiment, the target pixel potential V during charging changes as indicated by the dotted curve in FIG. 11A, and the target pixel potential V during discharging changes as indicated by the dotted curve in FIG. 11B. Letting the bias current (driving capability) change while suppressing any influence on the display of the display region 104 makes it possible to reduce the power consumption. In FIG. 11A, the solid curve indicates the potential change for the case that a conventional output buffer 302 is used, and the dash-dotted curve indicates the potential change for the case that the driving capability when the four Pch transistors $QP_0$ to $QP_3$ are operated simultaneously is slightly higher than the driving capability of the Pch transistor QP in the conventional example (FIG. 5). The solid curve, the dotted curve and the dash-dotted curve in FIG. 11B are analogous to FIG. 11A, except that they refer to the Nch transistors instead of the Pch transistors. Also in the case of a configuration with which a potential change as shown by the dash-dotted curve can be attained, the size (driving capability) of the four Pch transistors $QP_0$ to $QP_3$ and the four Nch transistors $QN_0$ to $QN_3$ can be set such that the power consumption of the output buffer 303 is reduced below that in the conventional example.

1.5 Advantageous Effects of the First Embodiment

With this Embodiment, the bias current is reduced during the period in which no large driving capability is needed, by changing the output conductance of the output buffer 303 in the D/A converter 203 at a time t1*a* or t1*b* after the charging or discharging has proceeded to a certain extent during the period of charging or discharging the pixel capacitances, which is the driving period of the pixels. Thus, it is possible to reduce the power consumption of the output buffer 303 in the D/A converter 203 while suppressing any influence on the display of the display region 104. Consequently, this embodiment is advantageous with regard to saving energy in liquid crystal display devices in which the proportion of power consumption of the driving circuit that is taken up by the power consumption of the output buffer is large.

1.6 Modified Examples of First Embodiment 1.6.1 First Modified Example

The following is a description of a first modified example of the first embodiment.

Figure 12:
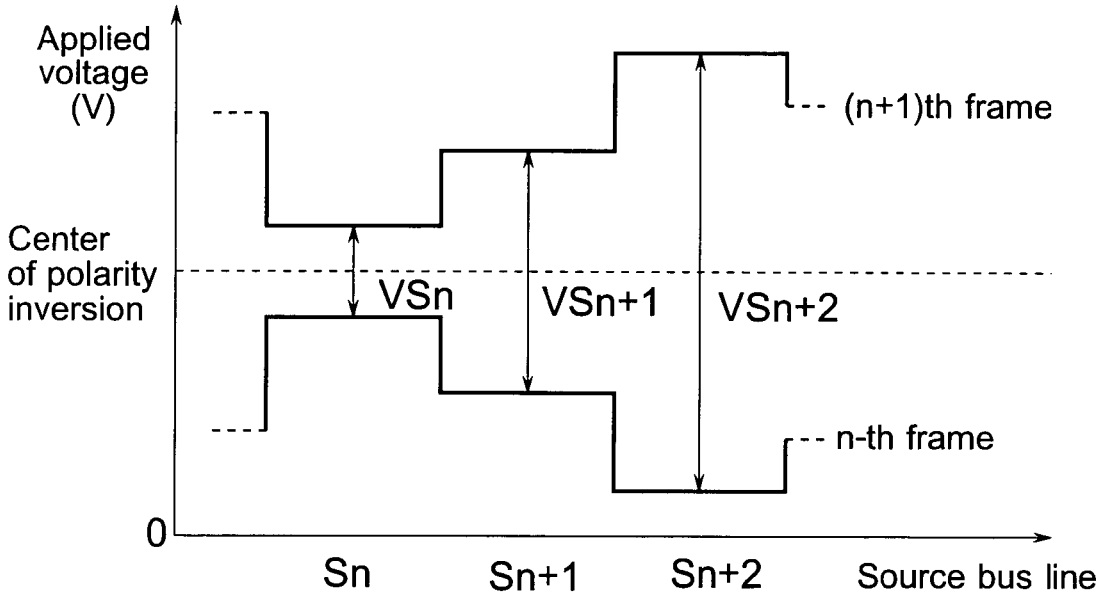
FIG. 12 is a signal waveform diagram illustrating the principle of a first modified example of the first embodiment.

If the images displayed on the display region are limited to still pictures, then the time at which the driving capability is dropped, that is, the time at which the bias current is decreased can be determined automatically by the following method. In order to prevent a deterioration of the liquid crystal in the liquid crystal display device, a voltage whose polarity is inverted at every frame is applied to the source bus lines, taking the potential of the opposing electrode as the reference. That is to say, in the case of still pictures, a voltage that is that of the n-th frame vertically inverted with respect to the center of the polarity inversion is applied to the (n+1)th frame, as shown in FIG. 12. Here, assuming that the display region 104 is a normally white display region that is the brighter the closer the applied voltage to the center of the polarity inversion, the voltage to be applied in the (n+1)th frame, that is, the potential difference between the n-th frame and the (n+1)th frame becomes smaller for brightly displayed pixels (VSn<VSn+1<VSn+2). Thus, if the time at which the driving capability is dropped is set to an earlier time for brightly displayed pixels, then the power consumption of the output buffer can be reduced even further. This is not only true when the potential of the common electrode is fixed as in the case shown in FIG. 12, but also in configurations in which the potential of the common electrode is switched between two potentials, namely a positive electrode potential and a negative electrode potential, in order to reduce the voltage necessary for driving.

Figure 13:
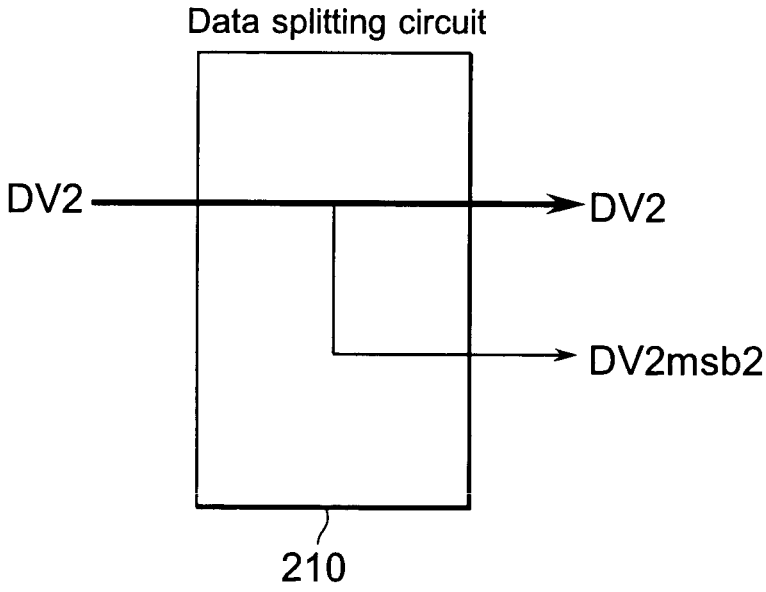
FIG. 13 is a diagram illustrating a data splitting circuit used in this first modified example.

Thus, in this modified example, the Pch control signal SPon and the Nch control signal SNon are generated on the basis of information indicating how bright the pixel to be driven should be displayed (see FIGS. 10A and 10B). Therefore, it is necessary to relay this information to the timing generator 201 generating the Pch control signal SPon and the Nch control signal SNon. This can be done, for example, by providing a data splitting circuit 210 as shown in FIG. 13 between the host interface 202 and the D/A converter 203 in the liquid crystal controller 101, and sending the two (or more) most significant bits DV2msb2 of the digital video signal DV2 to the timing generator 201. In this case, the timing generator 201 can set four different times as the times for dropping the driving capability (bias current), depending on DV2msb2. Consequently, the time for dropping the driving capability can be selected from four times, depending on the voltage applied to the pixels to be driven in the display region 104, so that the power consumption can be reduced even more effectively, while suppressing any influence on the display of the display region 104.

1.6.2 Second Modified Example

The following is a description of a second modified example of the first embodiment.

Figure 14:
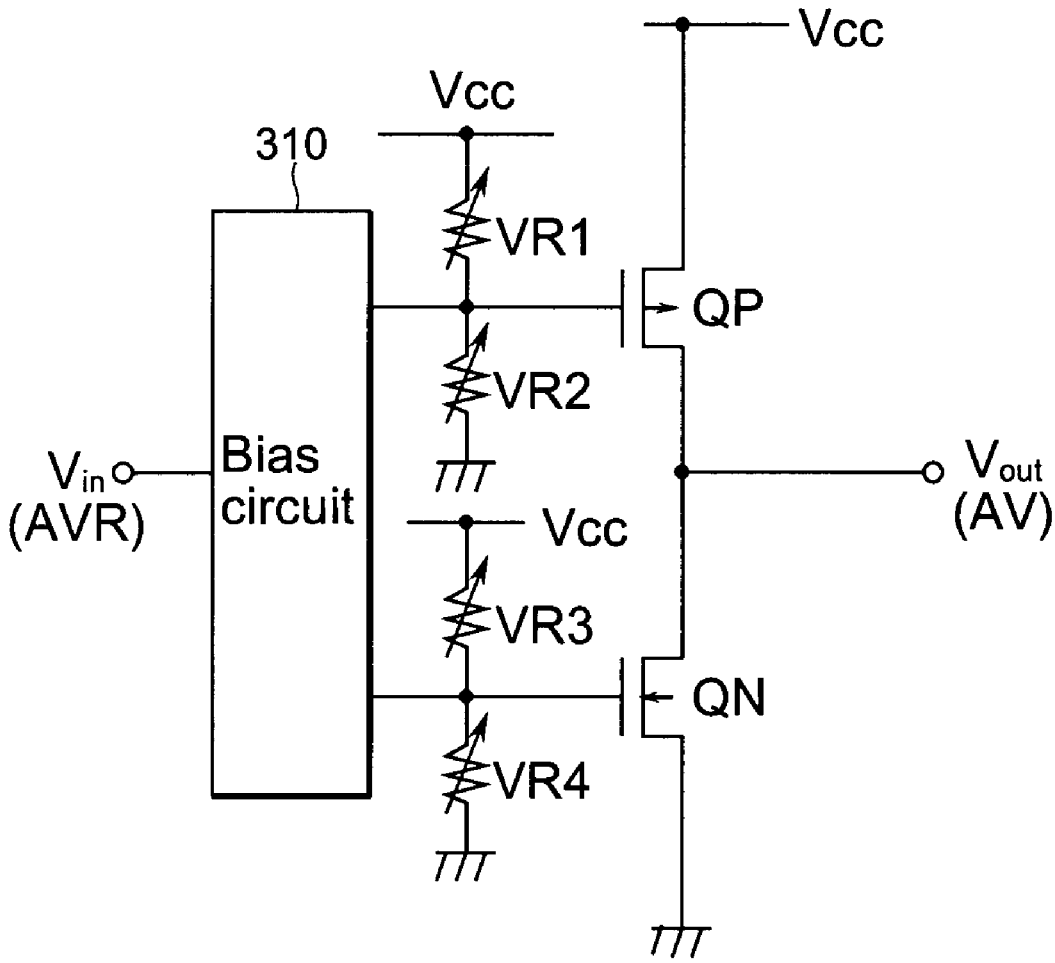
FIG. 14 is a circuit diagram showing the configuration of an output buffer according to a second modified example of the first embodiment.

In this modified example, an output buffer with the configuration shown in FIG. 14 is used instead of the output buffer in FIG. 8. With the output buffer 303 in the first embodiment, the bias current (driving capability) was controlled by changing the output conductance by altering the number of transistors connected in parallel in the output-stage CMOS circuit, but in the output buffer of this modified example, the bias current (driving capability) is controlled by altering the bias voltage (operating points of QP and NP) applied to the gate terminals of the Pch transistor QP and the Nch transistor QN. That is to say, the bias circuit 310 and the output-stage CMOS circuit are similar to the conventional example (see FIG. 5), but the gate terminal of the Pch transistor QP is connected to the power source line VCC via a first variable resistor $VR_1$ and to ground via a second variable resistor $VR_2$, whereas the gate terminal of the Nch transistor QN is connected to the power source line VCC via a third variable resistor $VR_1$ and to ground via a fourth variable resistor $VR_4$. That is to say, in this modified example, an operating point adjustment circuit made of the first to fourth variable resistors $VR_1$ to $VR_4$ is provided inside the output buffer. Thus, with such an output buffer, it is possible to reduce the bias current at the above-described time t1*a* in the charge period by controlling the variable resistors $VR_1$ and $VR_2$ with the Pch control signal SPon in the first embodiment, and to reduce the bias current at the above-described time t1b in the discharge period by controlling the variable resistors $VR_3$ and $VR_4$ with the Nch control signal SNon in the first embodiment. With such a configuration, the same advantageous effects as in the first embodiment can be attained.

1.6.3 Other Modified Examples

In the first embodiment, three Pch transistors $QP_1$ to $QP_3$ that are switched between operative and inoperative are connected to one another in parallel, and three Nch transistors $QN_1$ to $QN_3$ that are switched between operative and inoperative are connected to one another in parallel in the output buffer 303 shown in FIG. 8, but there is no limitation to the number of Pch transistors and Nch transistors switched between operative and inoperative, and it may also be less than three or more than three. Moreover, in the first embodiment, the output conductance was changed in two stages (in one stage, one Pch and one Nch transistor are operative, and in the other stage four Pch and four Nch transistors are operative) in the driving period (charge period or discharge period) for one pixel, but it is also possible to adopt a configuration in which the output conductance is changed in three or more stages by increasing the types of Pch control signals SPon and Nch control signals SNon, and controlling the selector switches $SP_1$ to $SP_3$ and $SN_1$ to $SN_3$ with a different timing. In that case, a more finely tuned control of the bias current, that is, the driving capability, aiming at reducing the power consumption of the output buffer 303 can be achieved.

Furthermore, in the above-described embodiment, the output buffer 303 is configured such that even when the Pch control signal SPon and the Nch control signal SNon are at L level, the Pch transistor $QP_0$ and the Nch transistor $QN_0$ are operative, but it is also possible to provide a selector switch for the Pch transistor $QP_0$ and the Nch transistor $QN_0$ as well, so that all Pch transistors and Nch transistors are switched between operative and inoperative. In this case, by setting all Pch transistors and Nch transistors to the inoperative state (off state) at a time when the charging or discharging of the pixel capacitance to be driven has sufficiently proceeded (i.e. the time corresponding to t1*a* or t1*b*), no more bias current flows after that time, so that the power consumption can be reduced even more than in the first embodiment.

Moreover, the first embodiment was premised on dot sequential driving, but also in the case of line sequential driving, an output buffer for applying an analog voltage to the source bus lines serving as the data lines is used, so that this output buffer can be configured similarly as in the above-described first embodiment or the modified examples. With such a configuration, the bias current or the driving capability in the output buffer can be changed while suppressing any influence on the display of the display region, so that the power consumption of the output buffer can be reduced.

2. Second Embodiment

In the first embodiment, the time at which the bias current of the output buffer 303 is lowered (t1*a*, t1*b*) is set in advance, but instead it is also possible to detect the time at which the value of the charge current or the discharge current in each driving period (charge period or discharge period) becomes lower than a predetermined value, and to reduce the bias current based on that detection result. The following is a description of a second embodiment of a liquid crystal display device using such an output buffer. It should be noted that the configuration of this embodiment is similar to that of the first embodiment, except that the configuration of the output buffer is different, and that the Pch control signal SPon and the Nch control signal SNon are not needed. Thus, identical portions are denoted by the same reference numerals, and their detailed description has been omitted.

Figure 15:
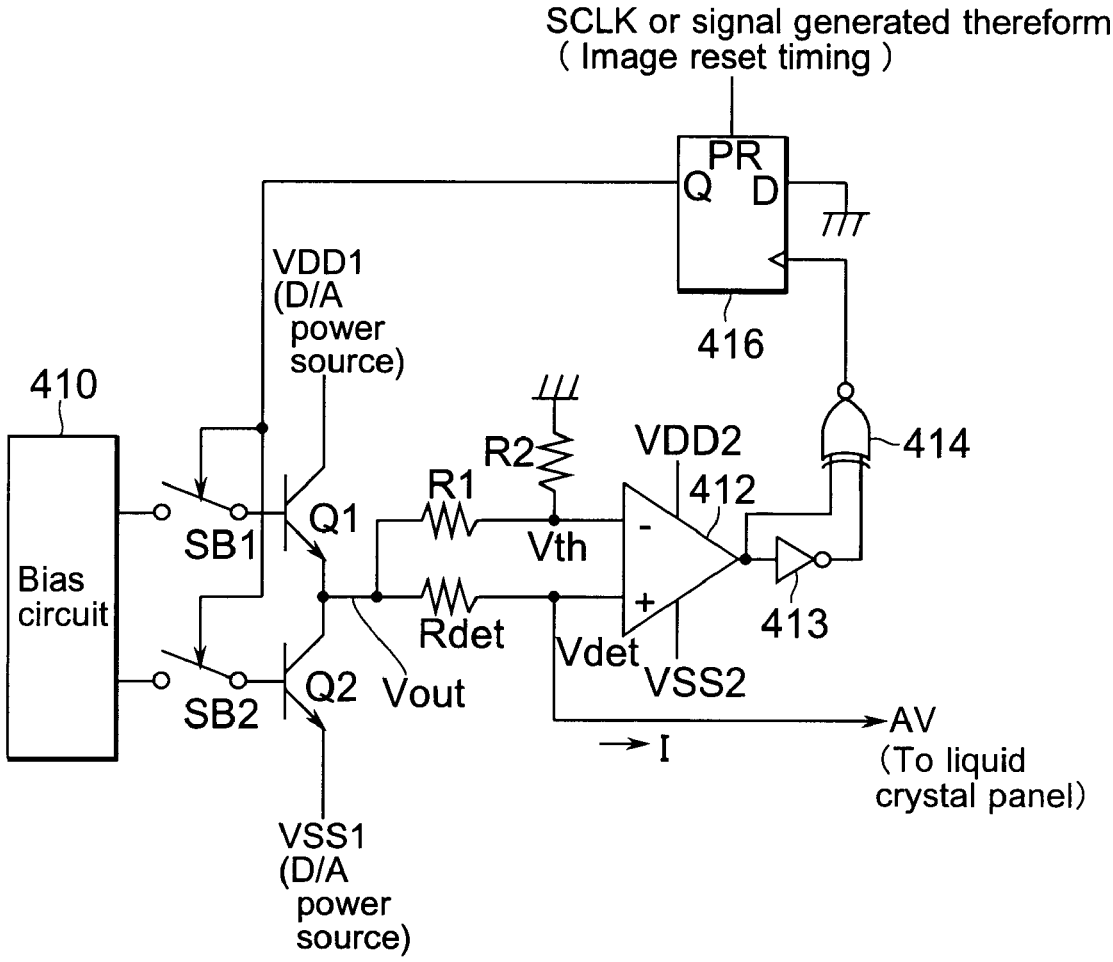
FIG. 15 is a circuit diagram showing an example of the configuration of an output buffer according to a second embodiment of the present invention.

FIG. 15 is a circuit diagram showing an example of the configuration of an output buffer that detects a bias current switching time based on the current value. FIG. 15 shows only the configuration for detecting the bias current switching time during the charge period, and the configuration for detecting the bias current switching time during the discharge period will be clear from the following descriptions of FIG. 15, so that no separate FIG. and description have been provided for that configuration.

The output buffer shown in FIG. 15 is provided with an output stage made of a bipolar transistor $Q_1$ whose collector is connected to a power source line VDD1, and a bipolar transistor $Q_2$ whose emitter is connected to a ground line VSS1. The emitter of the transistor $Q_1$ is connected to the collector of the transistor $Q_2$, and the voltage at that connection point (referred to as "output connection point" in the following) is the output voltage $V_{out}$. This output voltage $V_{out}$ is output from the output buffer via a current detection resistor Rdet, and supplied as the analog video signal AV through the source driver 102 to the display region 104 (source bus lines).

This output buffer further includes a bias circuit 410 and a comparator 412. The bias circuit 410 supplies a base current for operating the transistors $Q_1$ and $Q_2$ via the switches $SB_1$ and $SB_2$ respectively. The comparator 412 detects whether the charge current I for charging the pixel capacitance and the line capacitance of the display region 104 with the analog video signal, which is the output voltage $V_{out}$, has dropped below a predetermined value. One terminal of the current detection resistor Rdet is connected to the above-mentioned output connection point, whereas the other terminal is connected to the non-inverting input terminal of the comparator 412. The output connection point is also connected via the resistor R1 to the inverting input terminal of the comparator 412, and the inverting input terminal is connected via a resistor R2 to ground. A voltage Vth serving as a threshold value is generated by dividing the output voltage $V_{out}$ with the resistors R1 and R2, and the voltage Vdet at the other terminal of the current detection resistor Rdet, which is the voltage corresponding to the charge current I, is compared by the comparator 412 with the threshold voltage Vth.

Furthermore, this output buffer also includes a D flip-flop 416 and a circuit made of an exclusive NOR gate (EX-NOR gate) 414 and an inverter 413, which detects changes (from L level to H level or vice versa) in the output signal Sdet of the comparator 412. The output signal of this circuit is given into the clock terminal of the D flip-flop 416. The D terminal of the D flip-flop 416 is connected to ground, and the Q output signal controls the switches $SB_1$ and $SB_2$, which control the supply of the base current to the transistors $Q_1$ and $Q_2$. That is to say, when the Q output signal is at H level, the switches $SB_1$ and $SB_2$ are turned on, so that the transistors $Q_1$ and $Q_2$ are operative, and when the Q output signal is at L level, the switches $SB_1$ and $SB_2$ are turned off, so that the transistors $Q_1$ and $Q_2$ are inoperative (in off state). The source driver clock signal SCLK serving as the dot clock or a pulse signal derived from that source driver clock signal SCLK is entered into the PR (preset) terminal of the D flip-flop 416, in order to return the switches $SB_1$ and $SB_2$ to their initial ON state, every time charging of one pixel capacitance starts (every time the driving starts). If there is the possibility that the period for which the switches $SB_1$ and $SB_2$ are on, that is, the period for which a charge current is supplied from the output buffer, is shorter than the pulse width (H level period) of the clock signal SCLK, then it is preferable that the PR terminal is provided with a signal that is derived from the clock signal SCLK, but whose H level period is shorter than that of the clock signal SCLK.

Figure 16A:
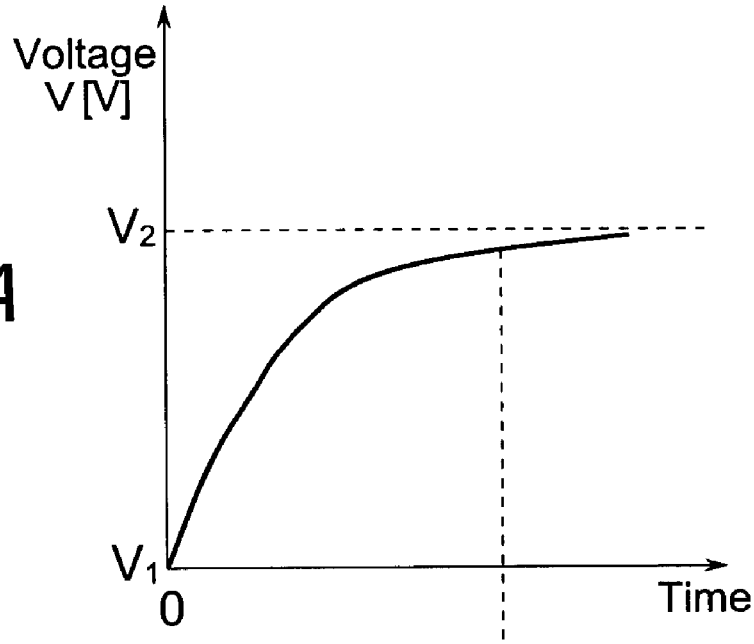
FIGS. 16A and 16B are waveform diagrams illustrating the operation of the output buffer according to the second embodiment.
Figure 16B:
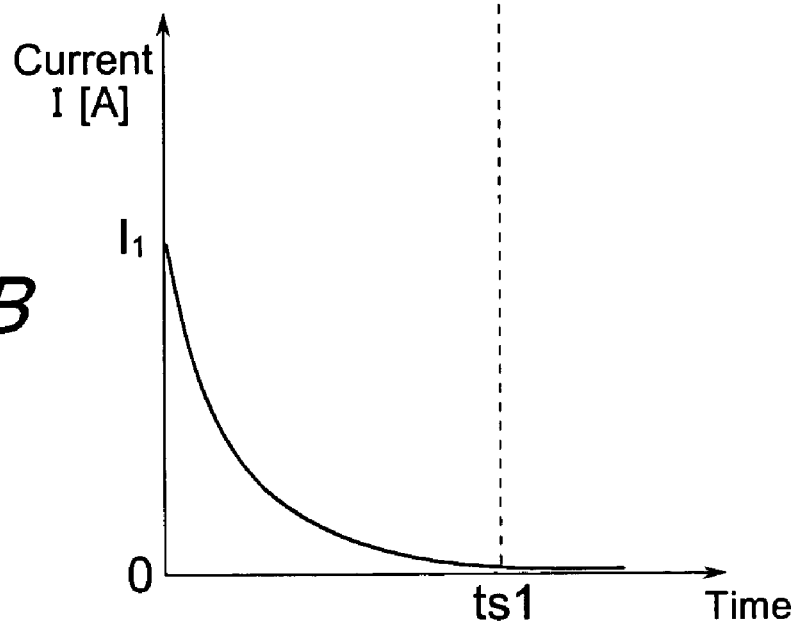

With the output buffer according to this embodiment as described above, as shown in FIGS. 16A and 16B, after the charging begins, the charge current I decreases as time passes, and if the voltage Vdet of the other terminal of the current detection resistor Rdet, which corresponds to that charge current I, becomes higher than the threshold voltage Vth or if it becomes lower than the threshold voltage Vth (in other words, if it crosses the threshold voltage Vth), then one pulse is input into the clock terminal of the D flip-flop 416. This causes the Q output terminal of the D flip-flop 416 to change to the L level at the time indicated by "ts1" in FIG. 16, thus turning off the switches $SB_1$ and $SB_2$ and setting the transistors $Q_1$ and $Q_2$ to the inoperative state (off state). As a result, no charge current is supplied from the output buffer to the display region 104 after that time ts1 during the charge period for one pixel. Yet by setting the threshold voltage Vth (the voltage division ratio of the resistors R1 and R2) such that that pixel capacitance is sufficiently charged at the time ts1, it can be ensured that no problems with regard to display occur even when the no charge current is supplied after the time ts1.

With this embodiment, no bias current flows from the power source line VDD1 via the transistors $Q_1$ and $Q_2$ to the ground line VSS1 after the time ts1 during the charge period for one pixel, that is, after that pixel capacitance has been sufficiently charged. Consequently, as in the first embodiment, the power consumption of the output buffer in the D/A converter 203 can be reduced while suppressing any influence on the display of the display region 104.

In the present embodiment, the charge period for one pixel is divided into a period during which charge current is supplied from the output buffer and a period during which charge current is not supplied, but it is also possible to reduce the bias current without putting the transistors $Q_1$ and $Q_2$ into a completely inoperative state (off state) during the period in which the supply of the charge current is stopped.

3. Other Embodiments

The descriptions of the foregoing embodiments and modified examples of the present invention were for liquid crystal display devices, but the present invention is not limited to these, and can also be applied to other display devices, as long as they are display devices that display images by applying an analog voltage to capacitive loads. For example, in display devices using an organic EL (electroluminescent) panel, images are displayed by controlling luminance with a current that flows through organic EL elements. If the pixel formation portions in the organic EL panel have the configuration shown in FIG. 17, then an image can be displayed by applying an analog voltage corresponding to the image signal to the source bus lines serving as the data signal lines.

Figure 17:
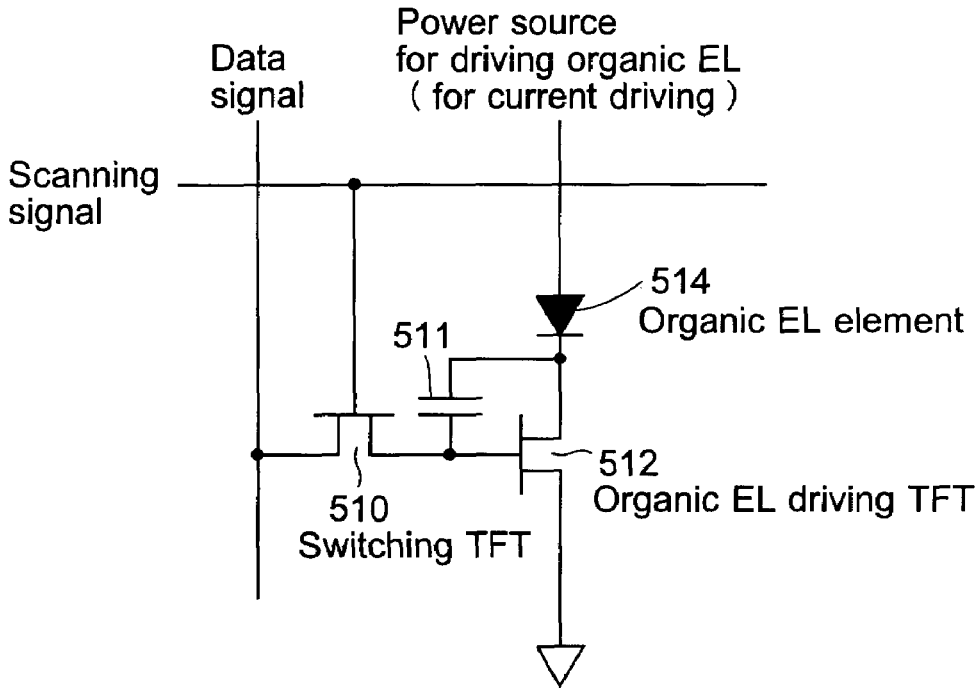
FIG. 17 is a circuit diagram illustrating how the present invention can be applied to a display device using an organic EL panel.

That is to say, this organic EL panel is an active-matrix display device, in which a plurality of scanning signal lines and a plurality of data signal lines are arranged in a grid on its display region, and a plurality of pixel formation portions are arranged in a matrix in correspondence with the intersections of the scanning signal lines and the data signal lines. Each of the pixel formation portions includes a switching TFT 510, an organic EL driving TFT 512, an organic EL element 514, and a capacitor 511. In these pixel formation portions, when the switching TFT 510 is turned on by a scanning signal on the scanning signal line passing through the corresponding intersection, the voltage of the data signal line is applied via the TFT 510 to the gate terminal of the organic EL driving TFT 512, and the capacitor 511, which is connected between the gate terminal and the source terminal of the TFT 512, is charged with the data signal. After that, even when the switching TFT 510 is turned off by the scanning signal, the voltage of the data signal is held by the capacitor 511. The voltage held by the capacitor 511 is converted into a current by the organic EL driving TFT 512. That is to say, the analog voltage applied to the capacitive load as the data signal is converted into a current. This current controls the luminance of the organic EL element 514, thereby displaying an image. Consequently, with a voltage-controlling configuration as shown in FIG. 17, the present invention can also be applied to display devices using organic EL elements.

It should be noted that if there is not a large difference between the driving voltage during adjacent charge periods or discharge periods when the display panel is actually driven, it is possible to maintain the bias current of the output buffer in its reduced state, that is, a state of reduced driving capability, while suppressing any influence on the display. For this reason, the present invention's advantageous effect of reducing energy consumption of the output buffer becomes even larger in such a case.

Moreover, in the first and second embodiments and the modified examples thereof, the driving capability of the output buffer is controlled by changing the bias current of the output buffer during the charge period or discharge period, which are the periods during which an analog voltage from the output buffer is applied to the capacitive loads in the display panel, and the power consumption is reduced while suppressing any influence on the display. However, the period in which the bias current can be changed in order to reduce power consumption is not limited to the charge period nor the discharge period, and it is also possible to change the bias current during other periods when driving the display panel (display region). For example, if there is a period during which the digital video signal DV1 serving as the input image signal includes no valid image information (such as the vertical blanking period) or a period during which it is not necessary to apply an analog voltage from the output buffer to the display panel while driving the display panel, then it is possible to prevent the bias current from flowing through the output buffer during those periods.

Furthermore, in the first and the second embodiment, the signals controlling the bias current of the output buffer (Pch control signal SPon and Nch control signal SNon) are generated by the timing generator 201 within the liquid crystal controller 101, and the timing generator 201 functions as a bias current control portion, but the implementation of the bias current control portion is not limited to this. For example, if an output buffer is provided for each source bus line, as in a line sequential driving-type display device, then it is also possible to provide a bias current control portion within the source driver (driving circuit) including those output buffers.

While the invention has been described in detail, the foregoing description is in all aspects illustrative and not restrictive. It is understood that numerous other modifications and variations can be devised without departing from the scope of the invention.

The present application claims priority upon Japanese Patent Application 2002-279937 titled "DISPLAY DEVICE, DRIVING CIRCUIT FOR THE SAME AND DRIVING METHOD FOR THE SAME," filed on Sep. 25, 2002, the content of which is hereby incorporated by reference.

What is claimed is:

1. A display device which includes a display portion having a capacitive load and an output buffer having a driving capability that depends on a bias current, and which displays an image on the display portion by letting the output buffer apply an analog voltage corresponding to an input image signal to the capacitive load to drive the display portion, the display device comprising:

a bias current control portion that controls the bias current;

wherein the output buffer is configured such that the bias current can be dynamically changed;

wherein the bias current control portion changes the bias current during a charge period or a discharge period, which is a period during which the output buffer is to apply the analog voltage to the capacitive load; and wherein the bias current control portion controls the bias current such that, after a predetermined time within the charge period or the discharge period, the bias current is smaller than at the beginning of the charge period or the discharge period.

2. The display device according to claim 1 wherein the output buffer comprises:

a plurality of transistors, connected in parallel, for outputting the analog voltage; and a switching circuit for switching at least one of the plurality of transistors between an operative state and an inoperative state; wherein the bias current control portion changes the bias current by changing the number of said plurality of transistors that are in the operative state with the switching circuit.

3. The display device according to claim 1 wherein the output buffer comprises:

a transistor for outputting the analog voltage; and an operating point changing circuit for changing an operating point of the transistor;

wherein the bias current control portion changes the bias current by changing the operation point of the transistor with the operating point changing circuit.

4. The display device according to claim 1, wherein the bias current control portion completely stops the bias current after the time that has been determined as the time within the charge period or the discharge period at which the bias current is to be reduced.

5. A display device which includes a display portion having a capacitive load and an output buffer having a driving capability that depends on a bias current, and which displays an image on the display portion by letting the output buffer apply an analog voltage corresponding to an input image signal to the capacitive load to drive the display portion, the display device comprising:

a bias current control portion that controls the bias current;

wherein the output buffer is configured such that the bias current can be dynamically changed;

wherein the bias current control portion changes the bias current during a charge period or a discharge period, which is a period during which the output buffer is to apply the analog voltage to the capacitive load; and wherein the bias current control portion determines, based on the input image signal, a time within the charge period or the discharge period at which the bias current is to be reduced, and controls the bias current such that, after that determined time, the bias current is smaller than at the beginning of the charge period or the discharge period.

6. The display device according to claim 5, wherein the bias current control portion completely stops the bias current after the time that has been determined as the time within the charge period or the discharge period at which the bias current is to be reduced.

7. A display device which includes a display portion having a capacitive load and an output buffer having a driving capability that depends on a bias current, and which displays an image on the display portion by letting the output buffer apply an analog voltage corresponding to an input image signal to the capacitive load to drive the display portion, the display device comprising:

a bias current control portion that controls the bias current;

wherein the output buffer is configured such that the bias current can be dynamically changed;

wherein the bias current control portion changes the bias current during a charge period or a discharge period, which is a period during which the output buffer is to apply the analog voltage to the capacitive load; and wherein the bias current control portion determines, based on a charge/discharge current flowing between the output buffer and the capacitive load, a time within the charge period or the discharge period at which the bias current is to be reduced, and controls the bias current such that, after that determined time, the bias current is smaller than at the beginning of the charge period or the discharge period.

8. The display device according to claim 7, wherein the bias current control portion completely stops the bias current after the time that has been determined as the time within the charge period or the discharge period at which the bias current is to be reduced.

9. A driving method for driving a display portion including a capacitive load, in order to display an image on the display portion, by applying an analog voltage corresponding to an input image signal to the capacitive load with an output buffer that has a driving ability that depends on a bias current, the driving method comprising:

a bias current changing step of changing the bias current while the display portion is driven, wherein, in the bias current changing step, the bias current is changed during a charge period or a discharge period, which is a period during which the output buffer is to apply the analog voltage to the capacitive load, and wherein, in the bias current changing step, the bias current is changed such that, after a predetermined time within the charge period or the discharge period, the bias current is smaller than at the beginning of the charge period or the discharge period.

10. The driving method according to claim 9, wherein in the bias current changing step, the bias current is completely stopped after the time that has been determined as the time within the charge period or the discharge period at which the bias current is to be reduced.

11. A driving method for driving a display portion including a capacitive load, in order to display an image on the display portion, by applying an analog voltage corresponding to an input image signal to the capacitive load with an output buffer that has a driving ability that depends on a bias current, the driving method comprising:

a bias current changing step of changing the bias current while the display portion is driven; and a time determination step of determining, based on the input image signal, a time within the charge period or the discharge period at which the bias current is to be reduced; wherein in the bias current changing step, the bias current is changed during a charge period or a discharge period, which is a period during which the output buffer is to apply the analog voltage to the capacitive load, and wherein in the bias current changing step, the bias current is changed such that, after that determined time within the charge period or the discharge period, the bias current is smaller than at the beginning of the charge period or the discharge period.

12. The driving method according to claim 11, wherein in the bias current changing step, the bias current is completely stopped after the time that has been determined as the time within the charge period or the discharge period at which the bias current is to be reduced.

13. A driving method for driving a display portion including a capacitive load, in order to display an image on the display portion, by applying an analog voltage corresponding to an input image signal to the capacitive load with an output buffer that has a driving ability that depends on a bias current, the driving method comprising:

a bias current changing step of changing the bias current while the display portion is driven; and a time determination step of determining, based on a charge/discharge current flowing between the output buffer and the capacitive load, a time within the charge period or the discharge period at which the bias current is to be reduced; wherein, in the bias current changing step, the bias current is changed during a charge period or a discharge period, which is a period during which the output buffer is to apply the analog voltage to the capacitive load, and wherein in the bias current changing step, the bias current is changed such that, after that determined time within the charge period or the discharge period, the bias current is smaller than at the beginning of the charge period or the discharge period.

14. The driving method according to claim 13, wherein in the bias current changing step, the bias current is completely stopped after the time that has been determined as the time within the charge period or the discharge period at which the bias current is to be reduced.

* * * * *